United States Patent [19]

Lerner et al.

[11] Patent Number: 4,640,731

[45] Date of Patent: Feb. 3, 1987

[54] APPARATUS FOR TAPING CARTONS

[75] Inventors: Joseph S. Lerner; David Krukas, both of Kings Park, N.Y.

[73] Assignee: The Loveshaw Corporation, Deer Park, N.Y.

[21] Appl. No.: 728,728

[22] Filed: Apr. 30, 1985

[51] Int. Cl.[4] ..... B31B 1/72

[52] U.S. Cl. ..... 156/355; 156/468; 156/486; 156/511; 156/522; 156/530; 493/117

[58] Field of Search ..... 156/475, 486, 492, 522, 156/468, 510, 511, 526, 530, 355; 53/137; 493/115, 116, 117

[56] References Cited

U.S. PATENT DOCUMENTS

| | | | |
|---|---|---|---|
| 3,560,308 | 2/1971 | Buck | 156/522 |
| 4,039,367 | 8/1977 | Warshaw et al. | 156/486 |
| 4,045,273 | 8/1977 | Loveland et al. | 156/486 |
| 4,061,526 | 12/1977 | Warshaw et al. | 156/486 |

*Primary Examiner*—Michael Ball
*Assistant Examiner*—Jenna Davis
*Attorney, Agent, or Firm*—George J. Brandt, Jr.

[57] ABSTRACT

Apparatus for applying tape to a forwardly traveling carton includes a first projecting tape applicator which lies in the path of carton travel. As the carton strikes the first applicator, tape is applied to the carton front panel, the traveling carton depressing the applicator to allow it to apply and wipe tape around the corner formed by the front panel and onto a horizontal panel. A push finger carried on the tape applicator engages for a time with a tape cutter. On engagement of the push finger with a cam near completion of unit depression travel, the finger disengages the cutter and releases it to sever a tape length from the tape supply. A roller in the depressed applicator unit wipes the severed tape length along the horizontal panel for the length that the tape extends along the panel. A second tape applicator unit which moves from projecting to depressed position in tandem with the first unit is located downstream of the first applicator. As the traveling carton moves beyond the first applicator, the depression constraint releases so that the second unit tends to project, and tape from a second supply roll is applied to the carton horizontal panel a distance spaced from where the first tape length ends. This last applied tape is applied around the corner formed by the carton's horizontal and rear panels. A second cutter severs this second tape length from its supply with roller means employed to wipe tape against the carton horizontal and rear panels.

15 Claims, 18 Drawing Figures

C
216
210
226
200
218
212
282
228
234
230
256
202
278
232
220
246
248
242
260
214,224
280
240
222
250
244
236
204
208
206

C
216
212
218
234
230
228
232
248
214,224
244
240
236
280
204

APPARATUS FOR TAPING CARTONS

BACKGROUND OF THE INVENTION

The sealing of shipping cartons particularly as is practiced in single passage of the carton through a taping apparatus, involves applying a continuous running length of sealing tape such as a pressure sensitive tape to the carton in a course starting on the carton front wall, around onto a horizontal panel, that is, onto the carton top or bottom, and then onto the carton rear panel where the tape course is terminated. While this practice is probably necessary for taping of cartons carrying contents of reasonably heavy weight and where the carton top and bottom panels are defined by infolded carton flaps abutting at horizontal carton seams, there are many instances where shorter discontinuous tape courses would suffice, thereby resulting in significant savings in the quantity of sealing tape required in connection with carton packing and shipping operations. Representative of such instances are packaging involving use of conventional types of cartons with infolded top and bottom flap members but which are employed for contents packaging of products that is relatively light so that subsequent filled carton handling operations will not result in adverse opening of the infolded top and bottom flaps if same are secured along seams with discontinuous tape lengths rather than with continuous lengths running along the full horizontal seam and onto both the front and rear carton panels. Another instance where effective tape securement can be achieved with discontinuous or discrete tape lengths is the use of telescopic type cartons where for example, a rectangular carton base is filled with product and a companion rectangular cover member is telescoped over the base and tape sealed thereto. The tape courses or runs with which such cartons can be sealed could follow "J" or "L" tape runs at the carton front and rear ends, the "J" or "L" defining the discrete tape run length from a front or rear panel onto a horizontal panel. While many types of tape sealing machines which tape in a continuous course from front to rear on a traveling carton are known to the present inventors, and while taping devices for applying a "J" or "L" tape course around a single carton or box corner onto two intersecting panels are known to them, they are not aware of any prior embodiment in taping apparatus of any means which allows simply achieved and effective tape sealing of "J" or "L" tape courses at both the front and rear of a carton as it travels in a single passage through taping apparatus.

SUMMARY OF THE PRESENT INVENTION

An object of the present invention is to provide apparatus for taping forwardly traveling cartons at the front and rear ends thereof with separate finite tape lengths extending from the front carton panel onto an adjacent carton horizontal panel and from said horizontal panel onto the carton rear panel in the form of finite length "J" or "L" tape courses.

Another object of the present invention is to provide taping apparatus which effects taping of cartons in a manner resulting in consequential reduction in the amount of tape required to securely close filled cartons.

In accordance with the present invention, taping apparatus for the objects and purposes aforesaid can be provided in a carton sealing machine of the type described in commonly assigned U.S. Pat. No. 4,039,367.

The carton sealing machine of that patent tapes cartons in a continuous tape run from a carton front wall or panel, onto a horizontal top or bottom wall or panel and then onto the carton rear wall or panel. For such purpose, the patented machine embodies a tape applying cartridge 21 as depicted in FIG. 2 of said patent. That cartridge is not capable of effecting "J" or "L" taping courses on cartons. The present invention provides a new cartridge construction which does allow for achievement of such taping operation. The other constructional features of the patented machine such as the base structure, elevator head structure, endless carton transporting belts etc. can be the same in the present apparatus and for such reason as well as the benefit of those skilled in the art, the disclosure of said patent is hereby incorporated herein.

The present apparatus includes transporting belts for transporting a carton in forwardly directed travel. In the path of travel is a normally projecting first tape applicator unit which presents pressure sensitive tape from a stock thereof in confronting array to the traveling carton, the applicator unit including an arm mounting a pair of spaced apart rollers, one of which presents the tape. A first tape cutter means is associated with the first applicator unit and normally is biased into a projecting position. A second tape applicator unit is disposed downstream of the first unit and it has associated with it a second tape cutter means, there further being a second stock or supply of pressure sensitive tape associated with the second tape applicator unit. In like manner to the similar components described in U.S. Pat. No. 4,039,367, the first and second tape applicator units are coupled to operate in tandem, that is, depression of the first applicator unit from its projecting position is accompanied by depression of the second applicator unit and upon release of depressive constraint therefrom, said units tend to return under bias forces applied thereto, to projecting position and finally do so when the traveling carton has passed downstream beyond the second tape applicator unit.

Carried on the arm of the first applicator unit is a push finger and fixed in the cartridge structure is a cam, the push finger being mounted on the arm to have ability to pivot relative to the arm through a limited pivoting course. The push finger has a shoulder portion thereon companion to a like configured part on the first cutter means, and the push finger also has a follower portion.

When the traveling carton front panel strikes the projecting first tape applicator unit, tape is applied to such panel and the continued carton travel initiates depression movement of the first applicator unit arm with concurrent or tandem depression of the second tape applicator unit initiating as well. As the first unit applicator arm is depressed, a roller thereon applies and wipes the tape to the carton front wall in a course directed to the corner formed by the front panel and an intersecting horizontal panel, i.e., a carton top or bottom wall. As the arm continues to be depressed, a second roller carried on the arm continues the tape wiping onto the horizontal panel. After the first applicator unit has been depressed a certain magnitude, the push finger shoulder portion engages the first cutter means to move it in depression from its normally biased projecting position and away from a location at which the cutter means could sever tape off-feeding from the first tape stock. At about the same time that the push finger shoulder portion is engaging the first cutter means, the follower portion thereof is moving to a position of coming into following engagement with the fixed cam which following engagement is intended to cause pivoting of the push finger more progressively as the first applicator unit arm continues to be depressed and to the extent that it finally will be pivoted sufficiently to cause disengagement of the push finger shoulder portion from the first cutter means as the depressing applicator unit arm nears its terminal depression movement. With disengagement of the push finger and cutter means, the now released cutter means is rapidly biased toward projecting position and in that travel severs the first tape feed and the second roller carried on the arm which is now fully depressed, completes the wiping of the tape length along the horizontal panel as the traveling carton passes thereover. During the cutting operation in which the tape is being cut while the carton is positioned over same, the tape disposes at an acute angle to the carton horizontal panel to facilitate and allow for the cutting.

The traveling carton continues to move forwardly and its front end section causes the second cutter means to depress from projecting position, the second tape applicator unit already being depressed but a roller thereon presenting a tape feed from a second stock thereof in confrontation to but spaced slightly away from the carton horizontal panel. As the rear end of the carton passes beyond the tip end of the depressed first applicator unit arm, the depression constraint thereon is released so that same now tends to return to projecting position. Full projecting return however, is not yet possible because the traveling carton will hold the second applicator unit depressed and its tamdem coupling to the first unit prevents first unit return. Sufficient projecting return movement does occur however so that the second tape applicator moves a short distance in projecting direction and tape is pressed and wiped against the carton horizontal panel in a length thereon adjacent the rear panel. When the carton rear end has passed beyond the second tape cutter means, the constraint on such cutter means is released and it returns to projecting position severing the second tape length from its stock. By this time, the traveling carton also will have passed beyond the second tape applicator unit and that unit will move toward its projecting position but limited in such movement by the engagement of a third tape wiping member downstream therefrom and also connected for tandem movement with the second unit. This third tape wiping member as soon as the carton passes beyond same, will move to projecting position and in so doing wipes the second tape length onto the carton rear panel beginning at the corner defined by said panel and the horizontal panel, and for a finite length on the rear panel.

The invention provides that the cam member can be an eccentric so that by rotatably adjusting same to different degree, the engagement of the push finger follower portion with the eccentric camming surface effects more or less rapid disengagement of the first cutter means to thereby control within a range the overall lengths of the tape applied at the front end of the carton. In similar fashion, the overall length of the tape applied at the rear end of the carton can be adjusted by adjustably altering the length of the first tape applicator unit arm since the sooner or the later the traveling carton passes beyond the tip end of said arm, the sooner or the later the second tape applicator is released to initiate application of tape to the carton horizontal panel. This can be accomplished by a separate arm tip end structure adjustably movable lengthwise of the remainder of the arm to correspondingly length or shorten the overall arm length.

As will be understood, the apparatus of the invention utilizes an element carried on a tape applicator unit taping arm to depress an associated tape cutter means until occurrence of an event, e.g., carton travel is employed to effect release of the cutter means to sever the tape length applied at the carton front end. In another form of the apparatus in which tape feed for tape supply at both front and rear of the carton comes from a common stock thereof, unilization is made of an air cylinder unit to assist in the release of the cutter means for severance of the tape length applied at the carton front end. In such form of apparatus, a pivoted tape applying arm and roller unit lies projecting in the path of an advancing carton, being connected for depression movement in tandem with a downstream pivoted arm carrying another roller. When the front end panel of a traveling carton strikes the tape applying unit, tape is applied to such panel and the arm unit is caused to depress by forward movement of the carton. As the arm unit is depressing, a latch member carried on the arm thereof engages a normally biased to projecting position cutter means and depresses the cutter means carrying it down and below the box line position, i.e., line along which, e.g., the carton bottom panel is moving. When the arm unit is depressed to the point where its roller is at the box line, the carton front panel will be taped and the taping will pass around onto the horizontal panel. Disposed in the carton travel path is a sensor for detecting the front end of the carton. The sensor can be in circuit with a control unit for operating a cylinder unit. Upon sensing the front end of the traveling carton when it reaches a predetermined location, that is when it has traveled a distance to have resulted in taping on the front panel with the taping having passed around onto the horizontal panel, the sensor signals the control unit to admit pressurized air to a cylinder unit connected at one end in fixed manner and at its other end to the downstream pivoted arm. As a result, the cylinder unit extends causing the downstream arm to depress to a greater extent than that caused merely by the depressing presence of the carton over the first applicator unit. Because of tandem connection of the downstream arm with the tape applying unit arm, the latter arm will also be caused to depress even further. During this further depression movement of the tape applying unit arm, the latch carried thereon and acting to depress the cutter means will contact a fixed cam and since the latch is pivoted to the tape applying unit arm, is caused to pivot out of contact with the cutter means releasing it to move in cutting direction while the tape applying unit arm is still traveling in depression direction with the consequence that the tape is pulled through the cutter means and severed leaving the desired "J" or "L" length thereof on the front of the carton.

When the carton front has traveled a further predetermined distance, a second sensor detects the carton front end and signals the control unit to release pressure from the cylinder unit. As a result the tandemly connected tape applying unit arm and downstream arm move in the projecting direction until the rollers thereon strike the carton horizontal panel at the box line. At that event the roller on the tape applying unit arm starts applying to the carton, the horizontal run of the "J" or "L" tape course to be applied at the rear of the carton. When the carton rear panel passes beyond the cutter means, the same is biased to projecting position and cuts the tape. As the downstream roller moves back from depressed position and beyond the box line, it wipes the severed tape to the carton rear panel.

The invention accordingly comprises the features of construction, combination of elements, and arrangement of parts in carton taping apparatus which will be exemplified in the construction hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings, in which.

Throughout the following description, like reference numerals are used to denote like parts in the drawings.

DESCRIPTION OF THE PREFERRED EMBODIMENTS

Figure 1:
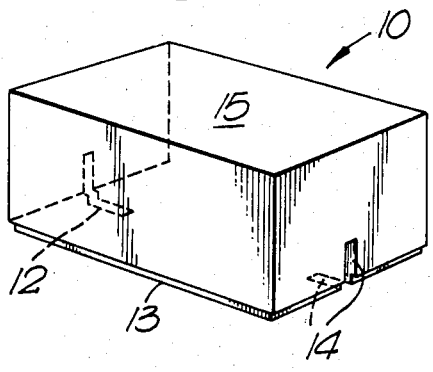
FIG. 1 is a perspective view of a carton showing the manner in which two discrete "L" or "J" tape courses are applied thereto at the front and rear ends of the carton with the apparatus of the present invention.

With reference to FIG. 1 of the drawings, there is shown a carton 10 of a type, e.g., a telescopic type with base and cover members and on which "J" or "L" tape courses are to be applied at the front end as at 12 and at the rear end is at 14. These are two fully separate tape courses and it will be noted a substantial untaped span exists at the bottom wall of the carton resulting in savings of substantial quantity of tape since with this type of carton the, courses 12 and 14 are more than adequate to hold the carton base 13 and cover members 15 together. It will be understood and appreciated by those skilled in the art that the described carton type is merely exemplary of the wide range of cartons and such construction thereof as can be taped with the apparatus of the invention. Further and as those skilled in the art readily will discern the apparatus while depicted and described as being at the carton bottom side also can be used at the top side or in fact at the side walls by suitable mounting of same so that taping can be effected at one, two or even four sides of the carton if desired.

Figure 2:
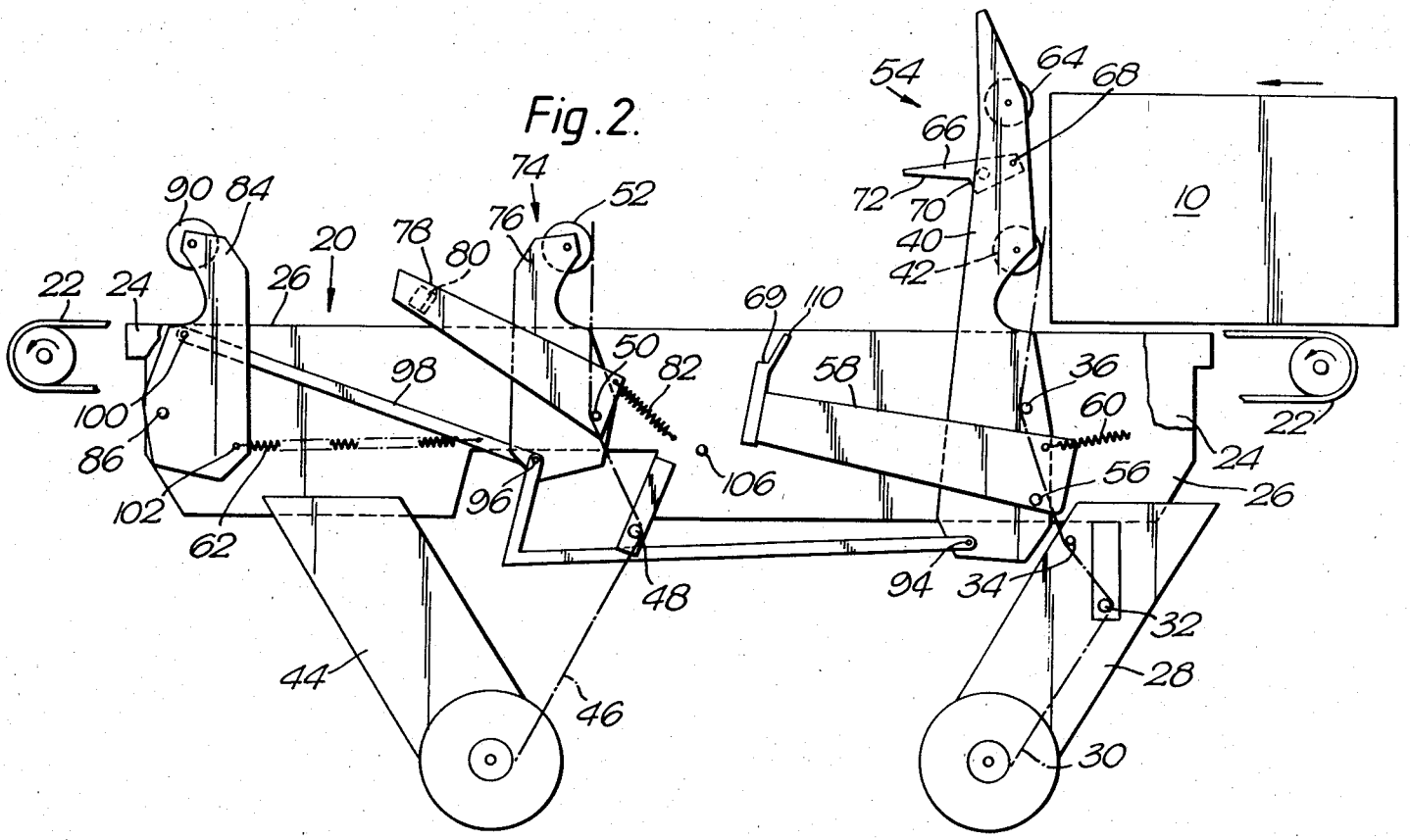
FIG. 2 is a side elevational view with portions cut away of the taping apparatus of the present invention showing the first and second tape applicators in projecting position and showing additionally a forwardly traveling carton about to strike the tape applying roller of the first tape applicator unit.
Figure 4:
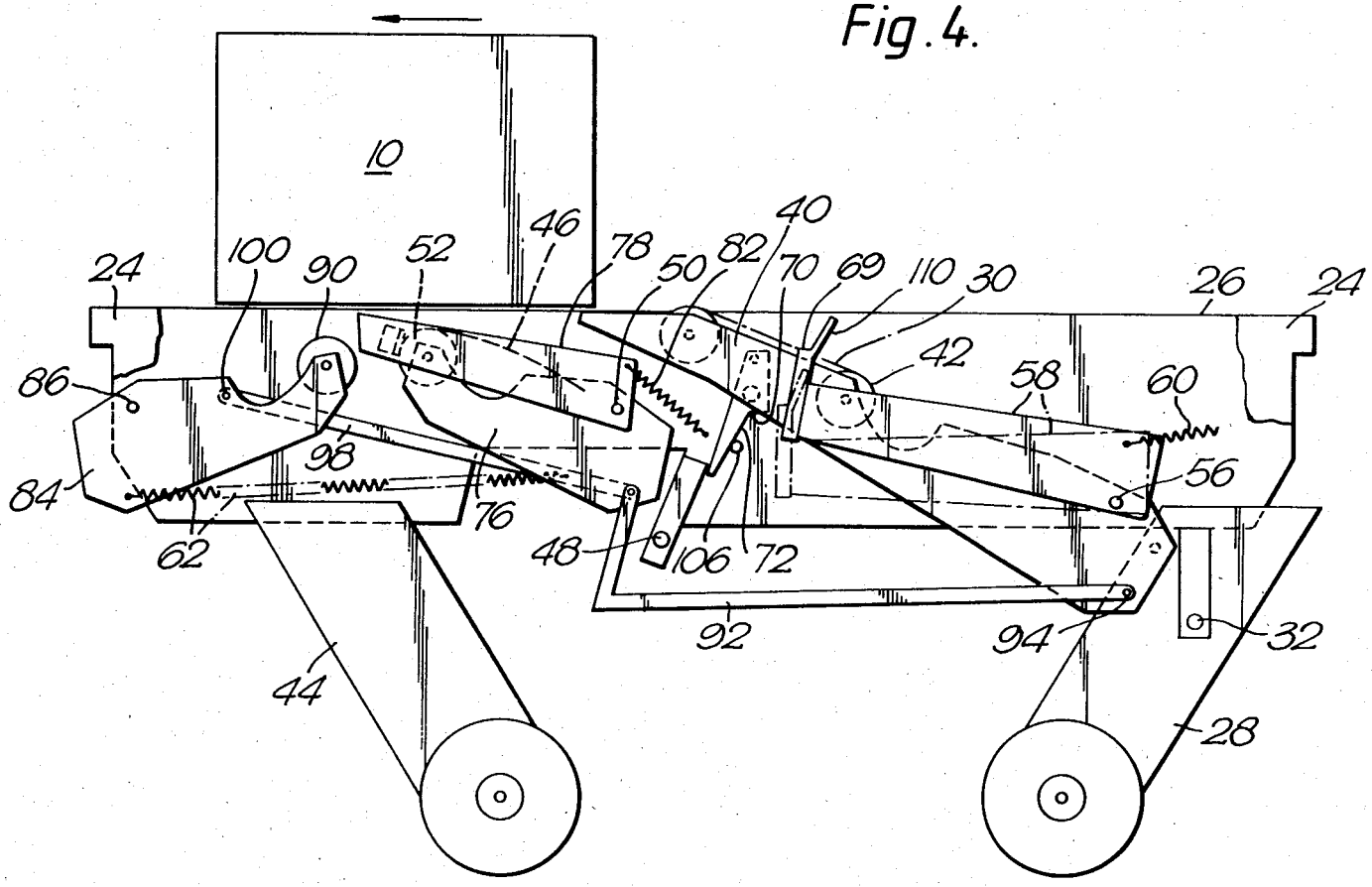
FIG. 4 is a side elevational view with portions cut away of the apparatus showing the first and second tape applicator units in retracted position, the traveling carton having advanced to the location where it is just about to pass beyond the tip end of the arm of the first unit, the first cutter means having moved in cutting direction to sever the first tape length as shown in solid lines, the maximum depressed position from which said cutter means had moved being shown in dashed lines.

FIGS. 2 and 4 shown the general overall constructional features of the present apparatus, the former when various components are in projecting position and the latter when same are depressed during taping operating. The apparatus includes a tape applying cartridge 20 like that depicted in U.S. Pat. No. 4,039,367 cartridge 20 for example, readily being adapted for mounting in the sealing machine described in said patent, cartridge 20 being straddled on either side by endless transport belt means 22 for transport of a carton in the forward direction, such belt means being substantially the same as shown in said patent. The cartridge 20 has spaced main side walls 24, 26 and secured to one of said walls as 26 is a first tape supply unit 28 mounting a first stock 30 of tape led upwardly from a roll and around tape guides 32, 34, and 36, the last of which guide 36 is carried on first tape applicator unit arm 40, the tape passing into tape roller 42 and thereby being presented to the front wall or panel of forwardly traveling carton 10, the carton in FIG. 2 being shown just about to strike the tape. A second tape supply unit 44 is connected to main wall 26 and mounts a second stock 46 of tape led upwardly from a roll and around tape guides 48 and 50, the guide 50 being the pivot mounting of a soon to be described second tape cutter means, such tape stock passing onto and having a free end terminating on tape roller 52 of a second tape applicator unit.

The first tape applicator unit shown generally at 54 includes the arm 40 which is pivoted as at 56 to the main walls. Mounted on that same pivot 56 is a first cutter means 58 normally biased to the projecting position by means of spring 60, the arm 40 also being under the projecting influence of bias spring 62 as shall be described later. Mounted adjacent to the free tip end of arm 40 is another tape roller 64 and carried on the arm 40 is push finger 66 pivoted to the arm as at 68 and having thereon a shoulder portion 70 and an angularly divergent follower portion 72 for purposes as will be described shortly. It will readily be understood that the components of the apparatus herein described are for convenience of illustration depicted in elevational view only. However it will be seen and understood that they follow and have as appropriate, the same general constructional make up as the like components shown in the aforementioned U.S. Pat. No. 4,039,367. Thus arm 40 herein is comprised of two spaced identically configured parts mounted on a pivot extending between the cartridge main walls, the cutter means 58 similarly includes two identically configured parts with a cutting element extending between such parts etc.

Downstream of the first tape applicator unit is a second tape applicator unit 74 which includes an arm member 76 pivoted to the main walls as at 50, that being as mentioned above a common pivot for second tape cutter means 78, the cutter member thereof being shown at 80 and being under the bias of spring 82. Further downstream of tape applicator unit 74 is movable arm member 84 pivoted to the main walls as at 86 and mounting at its free tip end a wiping roller 90. The first applicator unit 54, second unit 74 and arm member 84 have a tandem movement relationship. Thus when arm 40 is depressed by a traveling carton, arm 76 and arm member 84 likewise depress. This comes about by reason of coupling rod 92 (of generally J shape) being pivoted at one end as at 94 to arm 40 and at its other end to arm 76 as on pivot 96. Another straight coupling rod 98 extends from pivot 96 to pivot 100 carried on arm member 84. A tension spring 62 extending from pin 102 on arm member 84 to an intermediate length point on coupling rod 98 normally biases these respective arms to the projecting position. On the other hand, depression of the arm 40 in a counterclockwise direction will cause translation of coupling rod 92 with concurrent counterclockwise rotation of arm member 76 which in turn causes translation rightwardly of coupling rod 98 that in turn rotates arm member 84 clockwise so that all three arm components depress to the FIG. 4 position and spring 62 is placed under condition of tension.

Figure 3:
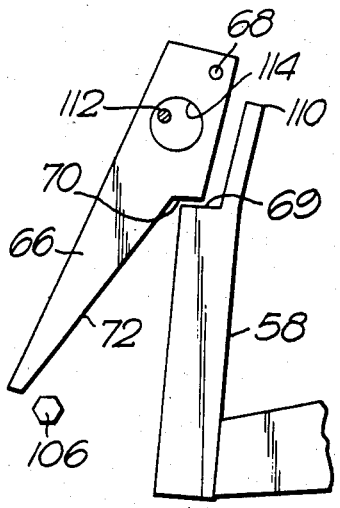
FIG. 3 is a fragmentary elevational view on enlarged scale showing the manner in which the push finger first engages the first cutter means to depress same in opposition to the bias thereon.
Figure 3A:
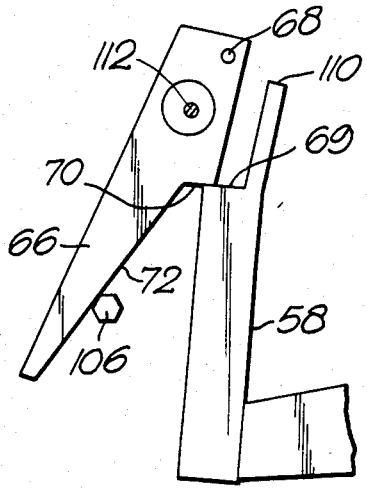
FIG. 3A is the same as FIG. 3 except it shows the push finger in an intermediate pivoted position and moving in the direction to disengage from the first cutter means.
Figure 3B:
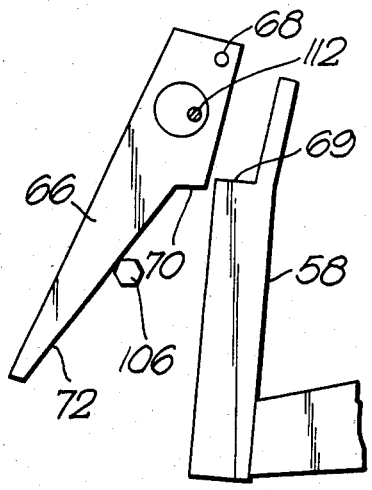
FIG. 3B is the same as FIG. 3A showing the finger position just after the shoulder surface thereon has disengaged from the companion surface of the first cutter means.
Figure 10:
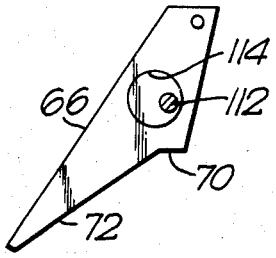
FIG. 10 is a fragmentary elevational view showing the stop member employed to limit push finger pivoting.
Figure 11:
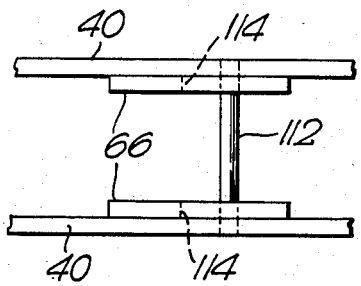
FIG. 11 is a top plan view of FIG. 10.

The second rotary cutter means 78 as can be seen from FIG. 4 is caused to depress by passage of the traveling carton against and over same. Cutter means 58 on the other hand is not depressed by carton travel but rather by the depression of arm 40 as will be described now with reference to FIGS. 2 and 3–3B. During depression movement of arm 40 and towards the final counterclockwise movement thereof, push finger 66 comes into proximity with the projecting cutter means 58 and more particularly, the shoulder portion 70 thereon engages with a complementally configured shoulder 69 on the cutter means and thereby depresses same counter to the bias of spring 60 such degree of engagement being that seen in FIG. 3. Also the follower portion 72 of the push finger engages a cam 106 fixed to the main walls 24, 26 and as the widening portion of the follower section descends in contact with the cam 106, the push finger is caused to pivot in a clockwise direction with the result that shoulder portion 70 thereof starts to move leftwardly relatively of cutter means shoulder 69, an intermediate position of engagement between the two shoulders being shown in FIG. 3B. Finally and just before the arm 40 has become fully depressed, the pivoting of the push finger reaches the point where shoulder 70 has moved leftwardly beyond shoulder 69 and the cutter means is released to return under bias of spring 60 to projecting position and during which movement the cutter edge 110 severs a length of tape from stock 30, such length being that applied in "J" or "L" configuration at the front end of the carton. Pivoting movement of the push finger is of limited extent, the extremes of which are set by the presence of stop rod 112 carried on arm member 40 and captive within enlarged opening 114 in the push finger as shown in FIGS. 10 and 11.

Figure 7:
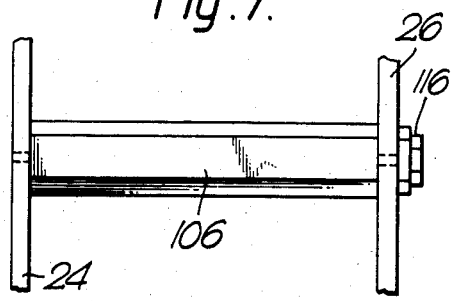
FIG. 7 is a fragmentary plan view showing how the cam means is mounted in the apparatus.

Cam member 106 preferably is provided as a hexagonal section member and is eccentrically mounted between the main walls so that the cam can be rotated to provide a greater or lesser eccentricity of surface engaged by the push finger follower portion 72. Thus with the cam positioned to present maximum eccentricity to finger follower position 72 movement, a more rapid release of the cutter means occurs and with minimum eccentricity, a slower release. The faster the release, the shorter will be the overall length of tape cut from the stock. As shown in FIG. 7, a locknut member 116 can be employed in conjunction with the mounting of the cam member to the main walls so that by loosening locknut 116 the cam can be adjustably rotated and upon desired setting thereof, the locknut taken up tight to prevent further rotation.

It will be understood that tape is applied by arm member 40 and roller 42 to the front panel of the carton 10 and that following contact of the carton with these components, arm 40 depresses and in so doing, the tape is pressed and wiped down against the front panel in the direction of its corner defined by the front panel and the carton bottom panel. Continued travel of the carton fully depresses arm 40, cutter means 58 operates to cut the tape and roller 64 wipes the cut tape length against the carton bottom panel. During the cutting of the tape by cutter means 58, and due to the roller 42 being positioned a distance below the box line, the tape feed 30 is disposed at an acute angle to the box line below the box when cutting of the tape occurs.

Figure 5:
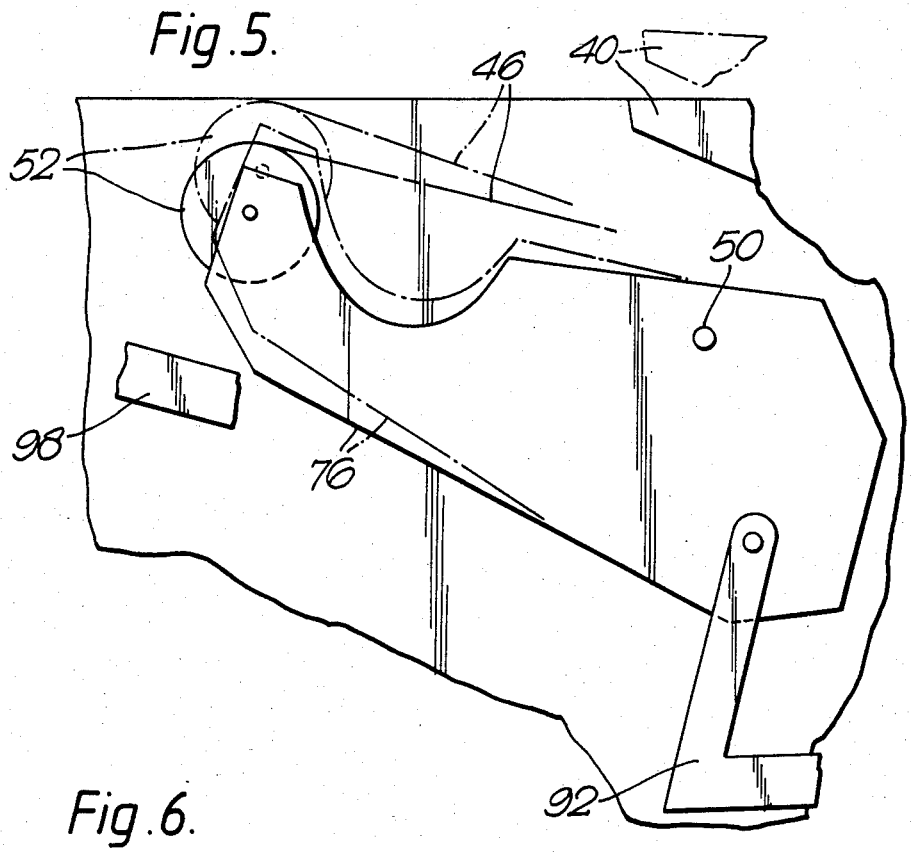
FIG. 5 is a fragmentary side elevational view showing how the tape applying roller of the second tape applicator unit moves up to apply tape to the carton underside upon release of constraint on the first tape applicator unit with passage of the carton beyond the tip end of the arm of said unit.
Figure 6:
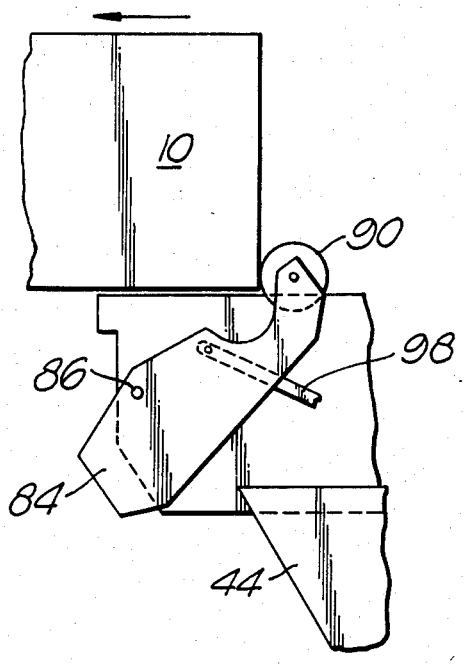
FIG. 6 is a fragmentary side elevational view showing how a downstream roller of the second tape applicator unit wipes tape to the rear wall of the traveling carton.

Taping at the rear end of the carton is effected by applicator unit 74. With references to FIGS. 4 and 5, the traveling carton in its forward travel will depress cutter means 78. When the rear end of the carton has passed beyond the tip end of arm 40, the depression constraint on that arm is released so it tends to return to projecting position under force of spring 62. That however cannot fully take place because constraint will still be applied though the arm members 76 and 84 tandemly coupled with arm 40 which are still depressed. Roller 52 it will be noted is spaced at this point slightly below the carton bottom but presents tape thereto. The release of constraint on arm 40 will however allow enough projecting movement in the coupled assembly to let arm 78 project up until roller 52 presses the tape feed against the carton bottom panel in the area thereof near the carton rear end. This limited projection movement is shown in FIG. 5 where arm 40, arm 76 and roller 52 move from the solid to dotted lines positions. The tape then is applied and wiped along the carton bottom panel towards the rear end thereof and until the carton rear panel passes beyond the tip end of depressed cutter means 78 so that spring 82 will cause the cutter means to project and its cutting edge 80 will sever a tape length from the stock 46. With constraint now off both arm 40 and arm member 76, and with the carton rear panel at a location allowing counterclockwise rotation of arm member 84, the spring 62 will function to rapidly rotate arm 84 so its roller 90 can wipe the cut tape length up the carton rear panel as shown in FIG. 6 and thereby complete the second "J" or "L" taping operation.

Figure 8:
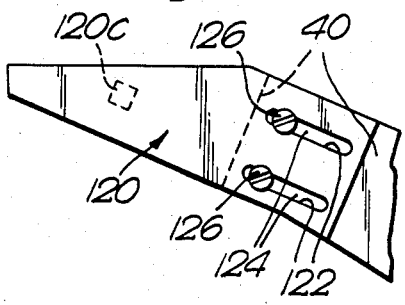
FIG. 8 is a fragmentary side elevational view showing the manner in which the tip end structure of the first applicator unit arm is adjustable lengthwise of said arm to vary the overall arm length.
Figure 9:
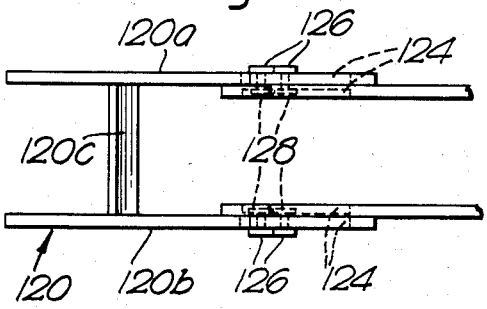
FIG. 9 is a plan view of FIG. 8.

FIGS. 8 and 9 depict the manner in which the overall length of arm member 40 can be lengthened or shortened to thereby control the length of the tape applied by applicator unit 74. Lessening the arm length lengthens to tape length since the carton passes beyond the arm sooner allowing projection of arm 76 to apply tape. Lengthening the arm 40 delays projection up of arm 76 and hence application of tape to the carton bottom panel. The tip end structure as at 120 of arm 40, made up of spaced tip pieces 120*a*, 120*b* joined by crosspiece 120*c* can be an independent component provided with slots 122. Like slots 124 are present in the remainder arm part. By sliding structure 120 longitudinally of the remainder arm part, the effective length of arm 40 can be changed. Set screws 126 secured in threaded members 128 carried engageable with retainer shoulders therefor formed in slots 124, can be employed to lock the structure to the remainder arm part.

FIGS. 12–16 depict a second form of the apparatus 200 with which cutter depressing means is employed along with means for releasing the cutter upon occurrence of a predetermined event (carton travel) to cut the tape length applied to the carton front end all as will now be described.

Figure 12:
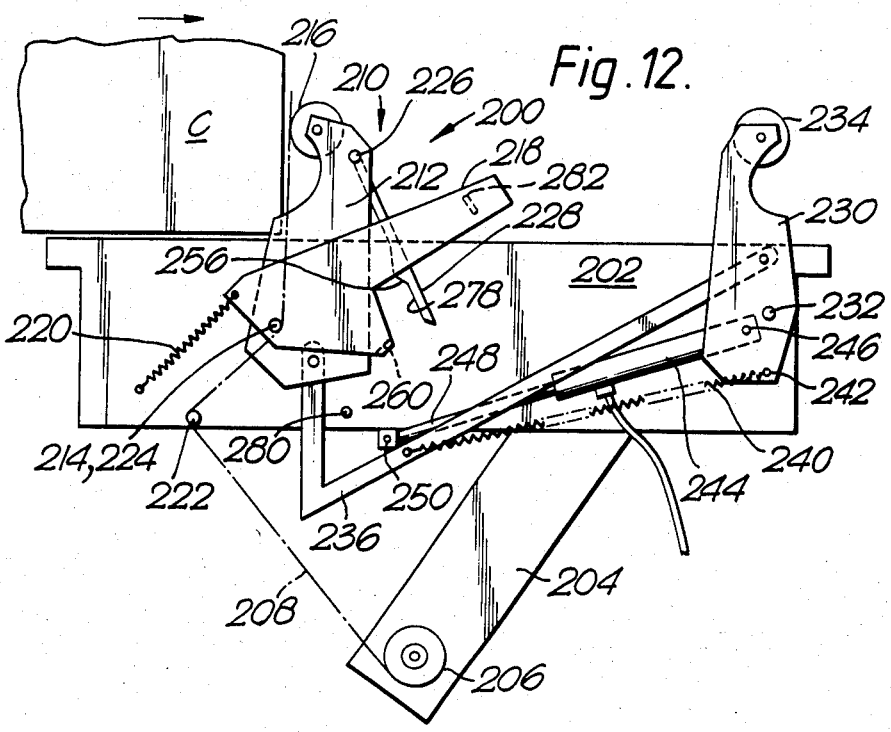
FIG. 12 is a side elevational view on enlarged scale showing another form of taping apparatus in which the front and rear carton end "L" or "J" tape feeds are supplied from a common tape stock and a cylinder unit is employed in connection with the severing of the tape course applied at the carton front end, the apparatus being depicted in a non-taping condition.

FIG. 12 shows apparatus 200 which can be employed in cartridge form as described earlier in connection with the FIGS. 1–11 embodiment, the cartridge having spaced main plates only one 202 being shown, and a bracket 204 depending from that plate for mounting a tape stock 206 from which off feeds tape 208. Carried in the cartridge is tape applying unit 210, having an arm 212 pivoted as at 214 and on the tip end of which is carried roller 216. Mounted on common pivot 214 is cutter means 218 biased to the shown projecting position by spring means 220. Tape feed is from stock 206, around guides 222, 224 and onto the roller 216 presenting the pressure sensitive face thereof to a traveling carton. Also carried on the arm 212 as by pivot 226 is a latch 228, the latch being under the bias of a tension spring encircling pivot 226 and engaging the latch to normally hold it at the position shown. A second arm 230 is mounted on pivot 232 downstream of unit 20 and carries a tip end roller 234, arm 230 being connected to arm 212 by coupling rod 236 to thereby have tandem rotative movement with such arm. A tension spring 240 connects an intermediate location of coupling rod 236 with a cross pin 242 on arm 230 to the effect that normal bias is applied to arms 212, 230 tending to project same. An air cylinder 244 is fixed at one end as to pin 246 on arm 230 and the rod member 248 is fixed to a pin 250 fixed on mounting plate 202. As a result, energizing of the cylinder unit with air under pressure results in the cylinder sliding rightwardly of the shown position.

Figure 13:
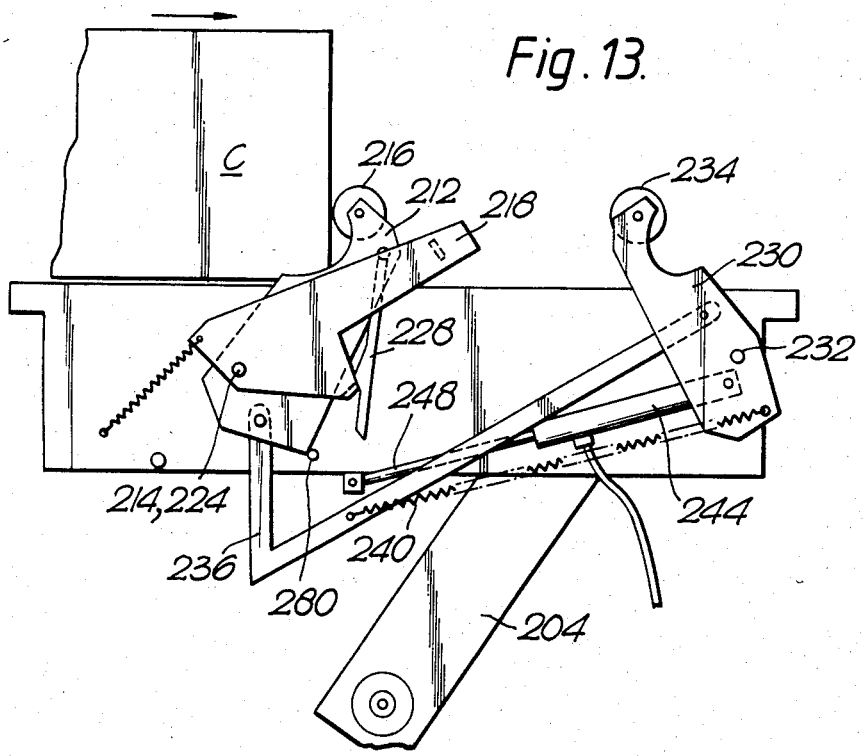
FIGS. 13–15 are schematic depiction of the positions of the components in the FIG. 12 apparatus as exists during the carton taping operation.
Figure 14:
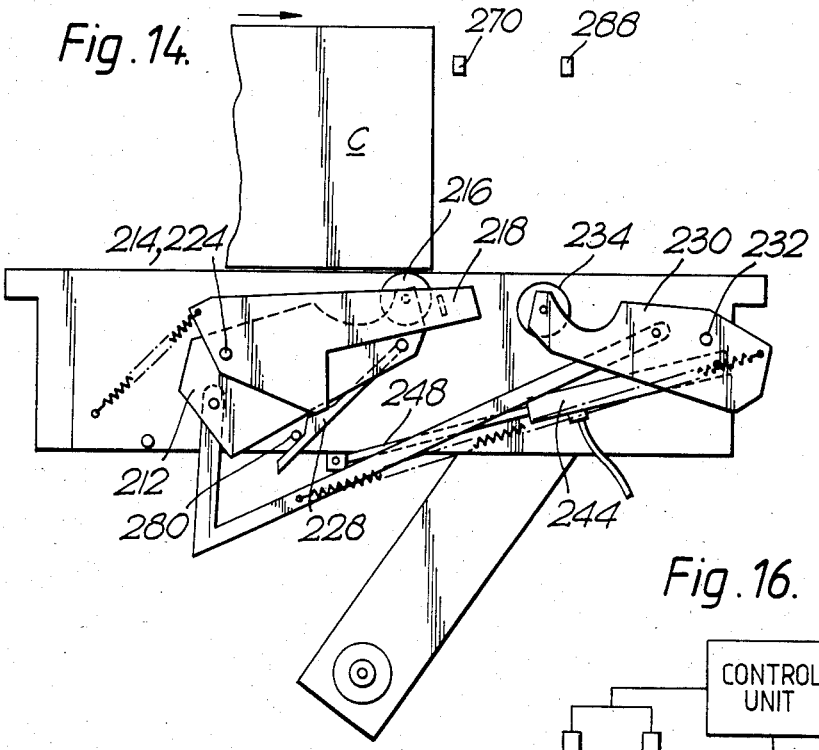
Figure 16:
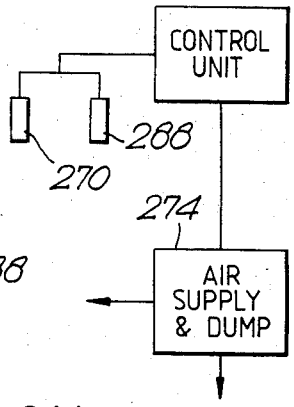
FIG. 16 is a schematic diagram of the control devices employed for controlling cylinder unit operation in the FIG. 12 apparatus.
Figure 15:
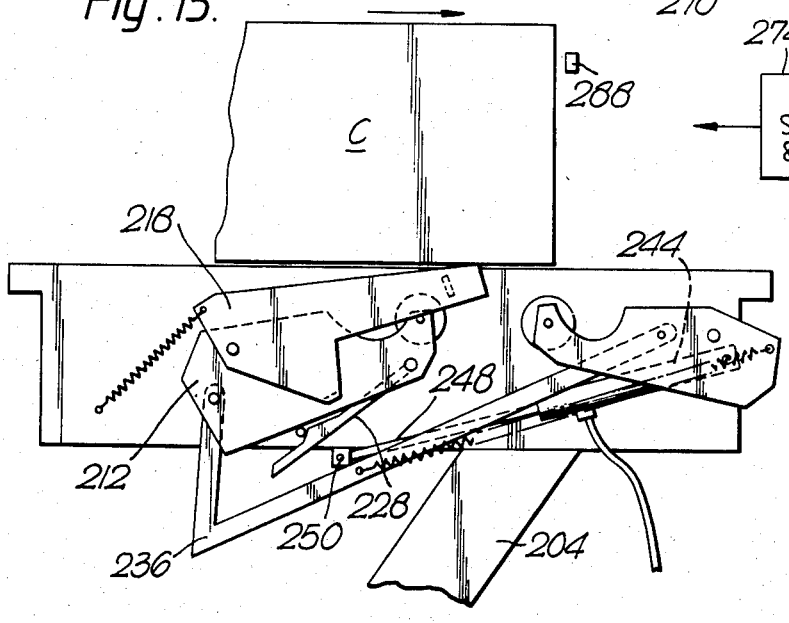

Further understanding of the apparatus 200 will be had with reference to FIGS. 12–16 and description of how same applies "J" or "L" tape courses at the carton front and rear ends. As the carton C strikes tape presented by roller 216 and such roller in its forward travel will pivot arm 212 clockwise starting the depression of same. The movement also will result in counterclockwise depression of arm 230. Cutter 218 will not yet pivot as it still biased as shown by spring 220. After the arm 212 has moved about half way down to the box line a shoulder 256 on latch 228 will engage with cross piece 260 on the cutter as shown in FIG. 13 so that continued depression of arm 212 will cause depression of the cutter carrying it below the box line as shown in FIG. 14 and in which Figure roller 216 has reached the box line, completed taping of the carton front end and the taping course is moving around onto the carton bottom horizontal panel. It is now necessary to cut the tape at the carton front end. When the carton front end reaches the sensor 270 such as a photo cell unit (although other types of sensors also could be used including air switch, microswitch, etc.), the sensor causes a signal to the control unit (FIG. 16) which in turn operates air supply unit 274 to admit pressurized air to the cylinder unit. With the air admitted to cylinder 244 and with rod 248 fixed, the cylinder will move rightwardly causing a greater counterclockwise depression of arm 230 and correspondingly greater clockwise depression of arm 212 below the box line to the extent that tip portion 278 of latch 228 now snubbed against stop 280 causes the latch to move slightly rightwardly releasing cutter 218 from the depression constraint so spring 220 repidly rotates same counterclockwise which rapid movement coupled with the arm 212 clockwise rapid depressive movement pulls tape 208 through the cutter cutting edge 282 severing the requisite length therefrom. Following cutting, the tip end of cutter 218 projects only to the box line since the carton now holds the cutter depressed in the last described position (FIG. 15). With the carton now having the front end thereof taped and it moving in forward direction, it is necessary to dispose the apparatus for taping the carton rear end. With the cylinder unit under pressure, roller 216 which presents the tape is still depressed a distance below the box line. When the carton front end passes a second sensor 288, it causes appropriate signal to the control unit to dump air pressure from the cylinder unit and as a result arms 212 and 230 can swing in projecting direction until the rollers carried thereby strike the box bottom panel at the box line, roller 216 starting therewith to apply tape to the bottom panel adjacent the rear end of the carton. As soon as the carton rear panel passes beyond the tip end of cutter 218, the cutter rotates up to the FIG. 12 position in the course of which it cuts the tape. As the carton moves forwardly of the box line position of roller 234, arm 230 now is free to rotate clockwise toward projecting position and in that movement, roller 234 will wipe the severed tape length a distance up the carton rear wall completing the taping operation.

It will be seen that the present invention provides an important improvement in taping apparatus for applying "J" and "L" taping courses to cartons. It will be appreciated that various modifications can be made to the apparatus without departing from the scope of the inventive concept disclosed.

What is claimed is:

1. Apparatus for applying sealing tape to front and rear ends of a forwardly traveling rectangular carton and in two respective courses the first of which runs in part on the carton front vertical panel and around in part onto a carton horizontal panel and the second of which runs in part on said horizontal panel and around in part onto the carton rear vertical panel, said apparatus comprising a first movably mounted tape applicator normally biased into projecting position in the path of carton forward travel to present tape from a first stock thereof in confrontation to the carton front panel, said tape applicator including an arm having a first pressing member thereon for pressing tape against the carton front panel, the advancing carton countering a bias on said tape applicator and retracting same as it advances and causing the tape to be wiped against said front panel, first movably mounted cutter means including bias means tending to move said cutter means in a tape cutting direction, said tape applicator arm carrying a push finger which engages during at least a portion of the retraction movement of said applicator arm with said first cutter means for moving same in a direction opposite to said cutting direction, cam means disposed for engagement thereof by said push finger during the terminal portion of applicator arm retraction for causing release of said push finger from engagement with said first cutter means whereby said cutter means moves in cutting direction to sever a length of tape from said first tape stock, an additional pressing member carried on said tape applicator arm and disposed when said arm is retracted, in tape wiping relationship to the carton horizontal panel to press tape thereagainst, a second movably mounted tape applicator disposed downstream of the first and normally biased into projecting position in the path of carton forward travel but connected to said first tape applicator to retract in tandem therewith, said second tape applicator when retracted presenting tape from a second stock thereof in alongside spaced confrontation to said horizontal panel, said second tape applicator including an associated movably mounted second cutter means normally biased to extend into the carton travel path in a tape cutting direction but being held retracted in opposition to said bias as the carton travels holdingly against said associated second cutter means, forward travel of the carton beyond the retracted first tape applicator releasing said first tape applicator from retracted constraint so same is caused to tend to return to projecting position, return movement of the unconstrained first tape applicator being accompanied by said second tape applicator tending to move to projecting position and thereby pressing the tape from said second stock against said horizontal panel, passage of the forwardly traveling carton beyond said second cutter means releasing same whereby the bias acting thereon moves it in a cutting direction to sever a length of tape from said second tape stock, and a tape wiping member downstream of said second tape applicator and tandemly operable therewith to project extendingly from a retracted position thereof to wipe the length of severed tape from the second tape stock against the carton rear vertical panel.

2. The apparatus of claim 1 in which said first tape applicator arm is an elongated member pivoted at one end thereof for rotatable movement about a fixed axis, the first pressing member being carried on said arm spaced at a distance from the other end of said arm, said additional pressing member being carried on said first tape applicator arm adjacent the said other end thereof, said push finger being carried on said arm intermediate said first and said additional pressing members.

3. The apparatus of claim 2 in which said push finger is mounted on said first tape applicator arm for pivoting movement relative thereto and about an axis parallel to said fixed axis, said push finger having a shoulder portion for engaging a companion surface on said movably mounted first cutter means during retraction movement of said applicator arm and an elongate follower portion extending in angled relation to the disposition of said shoulder portion, said cam means being a fixed member, said push finger follower portion being engageable with said cam means during the retraction movement of said applicator arm to cause pivoting movement of said push finger thereby to cause release of said shoulder portion from engagement with said first cutter means after the last-mentioned means has been moved a predetermined distance in the direction opposite to its cutting direction movement.

4. The apparatus of claim 3 in which said cam means is an eccentric member and includes means for adjustably rotating said eccentric about an axis parallel to said fixed axis to position said cam means to present a minimum to maximum eccentricity engagement surface to the push finger follower section engaging therewith for correspondingly effecting more rapid or less rapid push finger rotation with consequent earlier or later release of engagement of said shoulder portion with said first cutter means.

5. The apparatus of claim 4 further comprising stop means carried on said first applicator arm and operative to limit the extent to which said push finger can pivot relative to said first applicator arm.

6. The apparatus of claim 5 in which said stop means comprises a pin fixed to said applicator arm and captured in an enlarged opening in said push finger.

7. The apparatus of claim 4 in which said cam means has a hexagonally shaped cross-section.

8. The apparatus of claim 3 in which said first movably mounted cutter means companion surface engageable with said push finger shoulder section is complementally configured with such push finger shoulder section.

9. The apparatus of claim 2 in which the first pressing member and the said additional pressing member are roller members fixed rotatably to said first applicator arm.

10. The apparatus of claim 2 in which the said other end of said first tape applicator arm is embodied as an independent structure adjustable longitudinally of the length of said first tape applicator arm for lengthening and shortening the overall length of said first tape applicator arm, there being means associated with said independent structure for fixedly locking same to said remainder length.

11. The apparatus of claim 10 in which both said independent structure and said remainder length have longitudinally directed slots therein, the locking means being received in such slots.

12. In apparatus in which a movable tape applying arm member for applying tape from a stock thereof to a forwardly traveling carton is retracted from a projecting position in the carton travel line to a position out of the carton line by contact of the carton therewith, and including a tape cutter normally biased to project into said carton line, complementally engageable latching means carried on said arm member and said tape cutter, said latching means being engaged by retractive movement of said arm member to effect retractive movement of said tape cutter away from said box line in opposition to a bias thereon, latch release means in the path of retractive movement of said arm member and disposed a predetermined distance from said box line, power operated means connected with said arm member for stroking said arm member a further distance beyond that which is caused by travel of the carton in contact therewith and sufficient to cause engagement of the latch release means with said latching means to unlatch said latching means, and means for sensing travel of the carton downstream a distance from first contact thereof with said arm member, said sensing means triggering operation of said power operated means to retract said arm member said further distance whereby the unlatched tape cutter moves in normally biased direction to sever the tape from the stock thereof.

13. The apparatus of claim 12 in which said latching means comprises an elongated latch member pivoted at one end to said arm member and being engaged by a bias member urging said latch member in a first direction, a complemental means on said tape cutter being an abutment thereon, said latch release means comprising a fixed stop member, said latch member engaging said stop member during the stroking of said arm member said further distance to urge said latch member in a second opposite direction and disengage it from said tape cutter abutment.

14. The apparatus of claim 12 in which said power operated means is a fluid operated cylinder unit.

15. The apparatus of claim 12 further comprising second sensing means disposed at a downstream location from said first-mentioned sensing means to sense arrival of the carton at said location and therewith terminate operation of said power operated means whereby said arm member can extend in a direction toward the box line.

* * * * *